US012049892B2

(12) United States Patent
Bae et al.

(10) Patent No.: US 12,049,892 B2
(45) Date of Patent: Jul. 30, 2024

(54) SCROLL COMPRESSOR HAVING SEPARATE FLOW PATHS IN COMMUNICATION WITH DIFFERENT BACK PRESSURE CHAMBERS

(71) Applicant: Samsung Electronics Co., Ltd., Suwon-si (KR)

(72) Inventors: Mooseong Bae, Suwon-si (KR); Jongsoo Noh, Suwon-si (KR); Sunghyuk Park, Suwon-si (KR); Sungchan Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/854,983

(22) Filed: Jun. 30, 2022

(65) Prior Publication Data

US 2023/0101084 A1 Mar. 30, 2023

Related U.S. Application Data

(63) Continuation of application No. PCT/KR2022/009322, filed on Jun. 29, 2022.

(30) Foreign Application Priority Data

Sep. 30, 2021 (KR) ..... 10-2021-0129408

(51) Int. Cl.
*F04C 18/02* (2006.01)
*F01C 1/02* (2006.01)
(Continued)

(52) U.S. Cl.
CPC ..... *F04C 18/0253* (2013.01); *F01C 1/0253* (2013.01); *F01C 1/0276* (2013.01);
(Continued)

(58) Field of Classification Search
CPC ..... F04C 18/0253; F04C 18/0215; F04C 18/0276; F04C 23/008; F04C 27/005;
(Continued)

(56) References Cited

U.S. PATENT DOCUMENTS 4,600,369 A * 7/1986 Blain ..... F01C 19/08 418/188
4,992,032 A * 2/1991 Barito ..... F04C 27/005 418/57

(Continued)

FOREIGN PATENT DOCUMENTS

JP 3004483 B2 * 1/2000 ..... F04C 27/005
JP 2006-322421 A 11/2006

(Continued)

OTHER PUBLICATIONS

English Machine translation of KR100631724B1 (translated via USPTO Fit database on Oct. 21, 2023) (Year: 2006).*

(Continued)

*Primary Examiner* — Dominick L Plakkoottam
*Assistant Examiner* — Paul W Thiede
(74) *Attorney, Agent, or Firm* — Jefferson IP Law, LLP

(57) ABSTRACT

A scroll compressor is provided. The scroll compressor includes a fixed scroll, an orbiting scroll configured to orbit with respect to the fixed scroll and including an orbiting end plate, and a main frame to which the orbiting scroll is coupled to orbit. The scroll compressor includes a compression chamber in which a refrigerant is compressed by the fixed scroll and the orbiting scroll, and a first back pressure chamber and a second back pressure chamber provided to communicate with the compression chamber. The first back pressure chamber and the compression chamber communicate with each other through a first flow path. The second back pressure chamber and the compression chamber com- (Continued)

municate with each other through a second flow path. A different intermediate back pressure is formed in the first back pressure chamber and the second back pressure chamber.

16 Claims, 9 Drawing Sheets

(51) Int. Cl.

| | |
|---|---|
| ***F01C 17/06*** | (2006.01) |
| ***F04C 23/00*** | (2006.01) |
| ***F04C 27/00*** | (2006.01) |
| ***F04C 29/00*** | (2006.01) |

(52) U.S. Cl.
CPC ..... *F04C 18/0215* (2013.01); *F04C 18/0276* (2013.01); *F04C 23/008* (2013.01); *F04C 27/005* (2013.01); *F04C 27/008* (2013.01); *F04C 29/0021* (2013.01); *F01C 17/066* (2013.01); *F04C 2240/40* (2013.01); *F04C 2240/60* (2013.01); *F04C 2240/80* (2013.01)

(58) Field of Classification Search
CPC ..... F04C 27/008; F04C 29/0021; F04C 2240/40; F04C 2240/60; F04C 2240/80; F01C 1/0253; F01C 1/0276; F01C 17/066
See application file for complete search history.

(56) References Cited

U.S. PATENT DOCUMENTS

| | | | | |
|---|---|---|---|---|
| 4,993,928 | A * | 2/1991 | Fraser, Jr. ..... | F04C 27/005 418/57 |
| 5,085,565 | A * | 2/1992 | Barito ..... | F04C 27/005 418/57 |
| 5,256,044 | A * | 10/1993 | Nieter ..... | F04C 27/005 418/57 |
| 6,203,299 | B1 * | 3/2001 | Williams ..... | F04C 28/265 418/57 |
| 6,561,776 | B2 | 5/2003 | Morozumi | |
| 7,331,774 | B2 | 2/2008 | Ueda et al. | |
| 10,138,887 | B2 | 11/2018 | Yosuke | |
| 11,187,231 | B2 | 11/2021 | Takashi et al. | |
| 2002/0020186 | A1 | 2/2002 | Morozumi | |

FOREIGN PATENT DOCUMENTS

| | | | |
|---|---|---|---|
| JP | 4544388 | B2 | 9/2010 |
| JP | 2014-125908 | A | 7/2014 |
| JP | 2014-129756 | A | 7/2014 |
| JP | 5601404 | B1 | 10/2014 |
| JP | 2021-038684 | A | 3/2021 |
| KR | 100631724 | B1 * | 10/2006 |
| KR | 10-2017-0122018 | A | 11/2017 |
| KR | 10-1973307 | B1 | 4/2019 |
| KR | 10-2020-0037730 | A | 4/2020 |

OTHER PUBLICATIONS

English Machine Translation of JP3004483B2 (Year: 2000).*
International Search Report Oct. 26, 2022 , issued in International Application No. PCT/KR2022/009322.

* cited by examiner

SCROLL COMPRESSOR HAVING SEPARATE FLOW PATHS IN COMMUNICATION WITH DIFFERENT BACK PRESSURE CHAMBERS

CROSS-REFERENCE TO RELATED APPLICATION(S)

This application is a continuation application, claiming priority under § 365(c), of an International application No. PCT/KR2022/009322, filed on Jun. 29, 2022, which is based on and claims the benefit of a Korean patent application number 10-2021-0129408, filed on Sep. 30, 2021, in the Korean Intellectual Property Office, the disclosure of which is incorporated by reference herein in its entirety.

BACKGROUND

1. Field

The disclosure relates to a scroll compressor includes a back pressure chamber and a flow path.

2. Description of Related Art

Generally, a compressor is a machine that receives power from a power generating device, such as an electric motor or a turbine, to compress air, refrigerant or various other working gases to increase the pressure. It is widely used in household appliances, such as refrigerators and air conditioners, or throughout the industry.

The compressor is classified into a reciprocating compressor in which a compression chamber, in which a working gas is sucked and discharged, is formed between a piston and a cylinder and the piston reciprocates linearly in the cylinder to compress the refrigerant, a rotary compressor in which a compression chamber, in which a working gas is sucked and discharged, is formed between a rolling piston that rotates eccentrically and a cylinder, and the rolling piston eccentrically rotates along an inner wall of the cylinder to compress the refrigerant, and a scroll compressor in which a compression chamber, in which a working gas is sucked and discharged, is formed between an orbiting scroll and a fixed scroll, and the orbiting scroll orbits with respect to the fixed scroll to compress the gas.

A scroll compressor is a device for compressing a gas, such as a refrigerant, by relative movements between fixed and orbiting scrolls each including a spiral wrap.

The scroll compressor includes a compression chamber formed by a fixed scroll accommodated in a sealed container and an orbiting scroll which orbits opposite to the fixed scroll. The compression chamber gradually narrows from the outer circumference toward the inner circumference by rotation of the orbiting scroll. The refrigerant is sucked in from the outer circumference of the compression chamber, compressed, and discharged into the sealed container from the center of the compression chamber.

When the refrigerant is compressed in the compression chamber, the pressure inside the compression chamber acts in a direction in which the orbiting scroll moves away from the fixed scroll. Therefore, a back pressure chamber, in which an intermediate pressure-refrigerant is charged and a pressure acts in a direction in which the orbiting scroll is closed to the fixed scroll, may be provided under the compression chamber.

Under a relatively large load, the back pressure due to the pressure in the back pressure chamber may be large, which may increase the friction loss of the components. On the other hand, under a relatively small load, the orbiting scroll may tilt and leakage may increase.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a scroll compressor capable of forming different back pressures through a plurality of back pressure chambers.

Another aspect of the disclosure is to provide a scroll compressor capable of reducing friction loss of components and axial leakage that may occur under a load different from a reference cooling load.

Another aspect of the disclosure is to provide a scroll compressor capable of preventing wrap breakage that may occur in a compression chamber by retracting an orbiting scroll faster when liquid is introduced under a partial load condition.

Additional aspects will be set forth in part in the description which follows and, in part, will be apparent from the description, or may be learned by practice of the presented embodiments.

In accordance with an aspect of the disclosure, a scroll compressor is provided. The scroll compressor includes a fixed scroll, an orbiting scroll configured to orbit with respect to the fixed scroll and including an orbiting end plate, a main frame to which the orbiting scroll is coupled to orbit, a compression chamber formed between the fixed scroll and the orbiting scroll, a first back pressure chamber formed by the main frame and the orbiting scroll, a first flow path provided to allow the first back pressure chamber and the compression chamber to communicate with each other, a second back pressure chamber formed by the main frame and the orbiting scroll and provided to be separated from the first back pressure chamber in response to an orbital motion of the orbiting scroll, and a second flow path provided to allow the second back pressure chamber and the compression chamber to communicate with each other.

A pressure of the first back pressure chamber may be different from a pressure of the second back pressure chamber.

The scroll compressor may further include a first sealing member mounting groove formed between the orbiting end plate and the main frame, and a first sealing member arranged in the first sealing member mounting groove.

The main frame may include a first outer wall, and a first inner wall inwardly spaced apart from the first outer wall so as to form the first sealing member mounting groove.

The first sealing member floats in the first sealing member mounting groove in response to driving of the scroll compressor, and the first sealing member separates the first back pressure chamber from the second back pressure chamber.

The pressure of the first back pressure chamber may be less than the pressure of the second back pressure chamber.

A height of the first outer wall may be greater than a height of the first inner wall.

The pressure of the first back pressure chamber may be greater than the pressure of the second back pressure chamber.

A height of the first outer wall may be less than a height of the first inner wall.

The scroll compressor may further include an Oldham ring provided to allow the orbiting scroll to orbit while preventing the orbiting scroll from pivoting.

The Oldham ring may be accommodated in the first back pressure chamber.

The orbiting scroll may further include a shaft coupler extending downwardly from the orbiting end plate, and the second back pressure chamber may be formed by the shaft coupler and the main frame.

The scroll compressor may further include a second sealing member mounting groove formed by a rear surface of the shaft coupler and the main frame, and a second sealing member arranged in the second sealing member mounting groove.

The main frame may further include a second outer wall provided to support a bottom of the shaft coupler, and a second inner wall inwardly spaced apart from the second outer wall so as to form the second scaling member mounting groove.

A height of the second outer wall may be greater than a height of the second inner wall.

The second sealing member floats in the second sealing member mounting groove in response to driving of the scroll compressor, and the second sealing member separates the second back pressure chamber from a high pressure region inside a body of the scroll compressor.

The scroll compressor is configured to prevent wrap breakage caused by liquid compression by retracting the orbiting scroll more quickly when liquid is introduced.

The scroll compressor further comprises an electric mechanism configured to provide a driving force to the orbiting scroll, the electric mechanism comprising a stator, a rotor rotating inside the stator, and a rotary shaft mounted inside of the rotor and configured to rotate with the rotor to transmit a rotational force to the orbiting scroll.

An internal pressure of the compression chamber acts in a direction in which the orbiting scroll moves away from the fixed scroll.

In accordance with another aspect of the disclosure, a scroll compressor is provided. The scroll compressor includes a fixed scroll, an orbiting scroll configured to orbit with respect to the fixed scroll and including an orbiting end plate, a main frame to which the orbiting scroll is coupled to orbit, a compression chamber formed between the fixed scroll and the orbiting scroll, a first back pressure chamber formed by the main frame and the orbiting scroll, a first flow path provided to allow the first back pressure chamber and the compression chamber to communicate with each other, a second back pressure chamber formed by the main frame and the orbiting scroll and provided to be separated from the first back pressure chamber in response to an orbital motion of the orbiting scroll, and a second flow path provided to allow the second back pressure chamber and the compression chamber to communicate with each other. The main frame includes a first outer wall and a first inner wall having different heights.

A pressure of the first back pressure chamber may be different from a pressure of the second back pressure chamber.

The scroll compressor may further include a first sealing member mounting groove formed between the orbiting end plate and the main frame, and a first sealing member arranged in the first sealing member mounting groove.

The first inner wall may be inwardly spaced apart from the first outer wall so as to form the first sealing member mounting groove.

The pressure of the first back pressure chamber may be less than the pressure of the second back pressure chamber, and the height of the first outer wall may be greater than the height of the first inner wall.

The pressure of the first back pressure chamber may be greater than the pressure of the second back pressure chamber, and the height of the first outer wall may be less than the height of the first inner wall.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, of which.

Throughout the drawings, it should be noted that like reference numbers are used to depict the same or similar elements, features, and structures.

DETAILED DESCRIPTION

Figure 1:
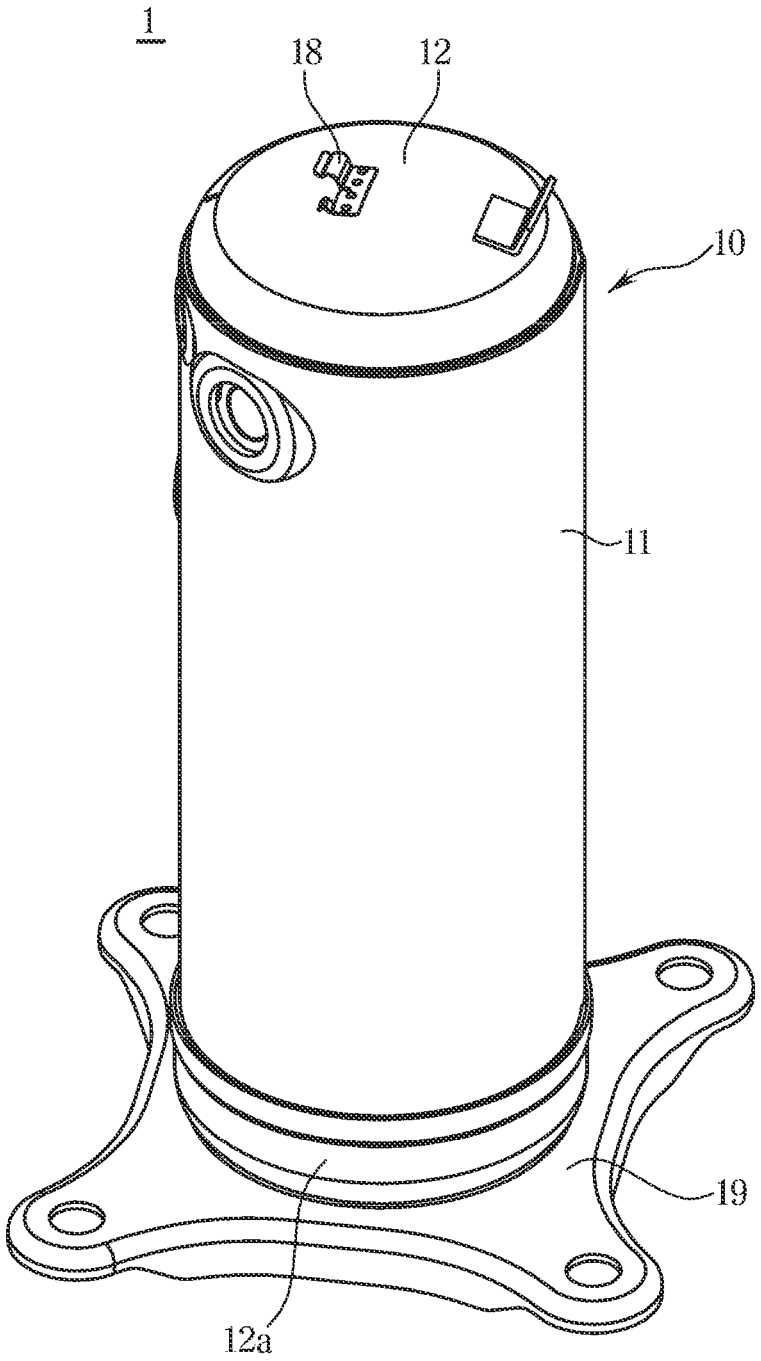
FIG. 1 is a perspective view of a scroll compressor according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including," "having," and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element.

The disclosure will be described more fully hereinafter with reference to the accompanying drawings.

FIG. 1 is a perspective view of a scroll compressor according to an embodiment of the disclosure.

Figure 2:
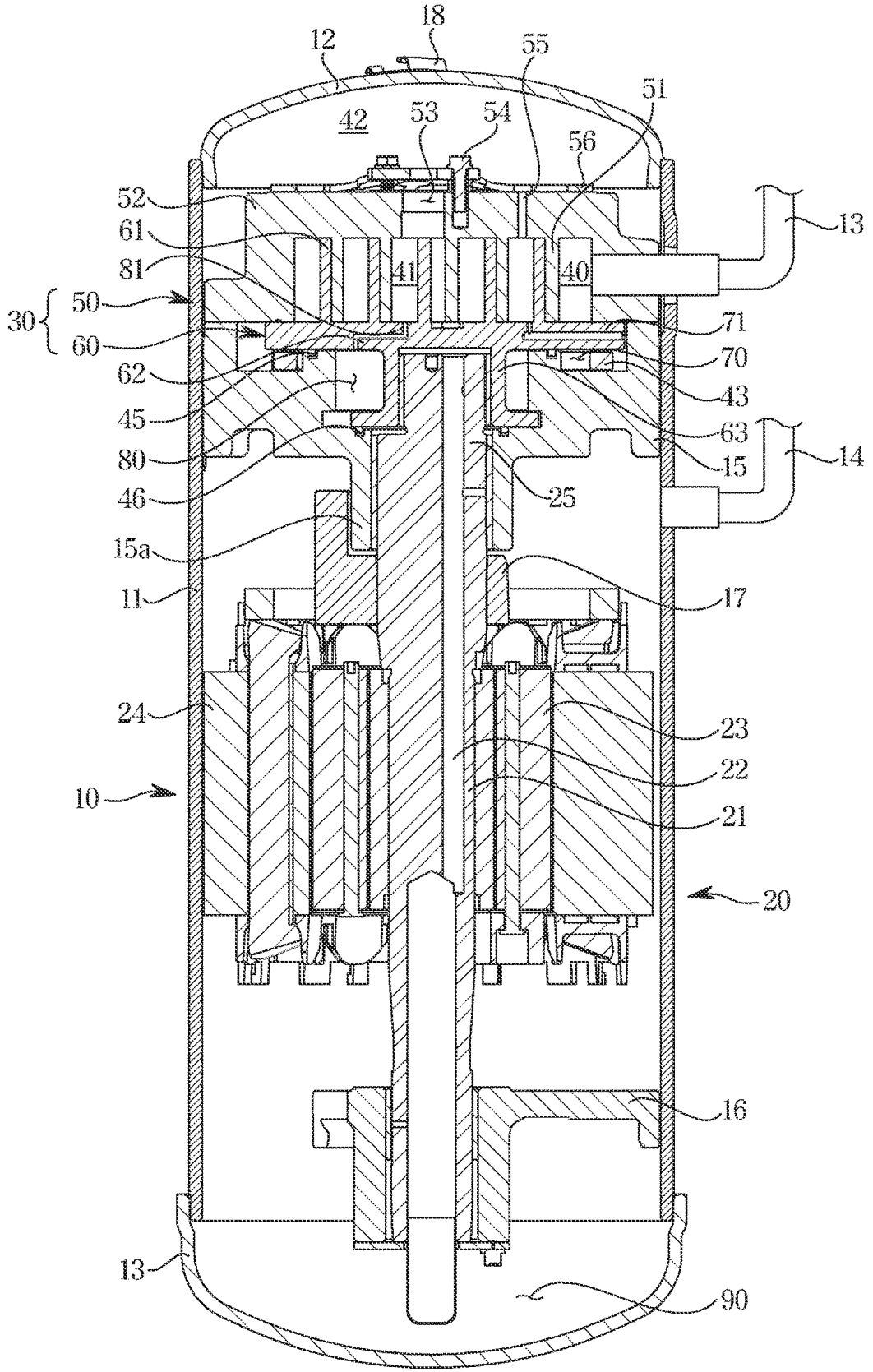
FIG. 2 is a side cross-sectional view of the scroll compressor according to an embodiment of the disclosure.

FIG. 2 is a side cross-sectional view of the scroll compressor according to an embodiment of the disclosure.

Figure 3:
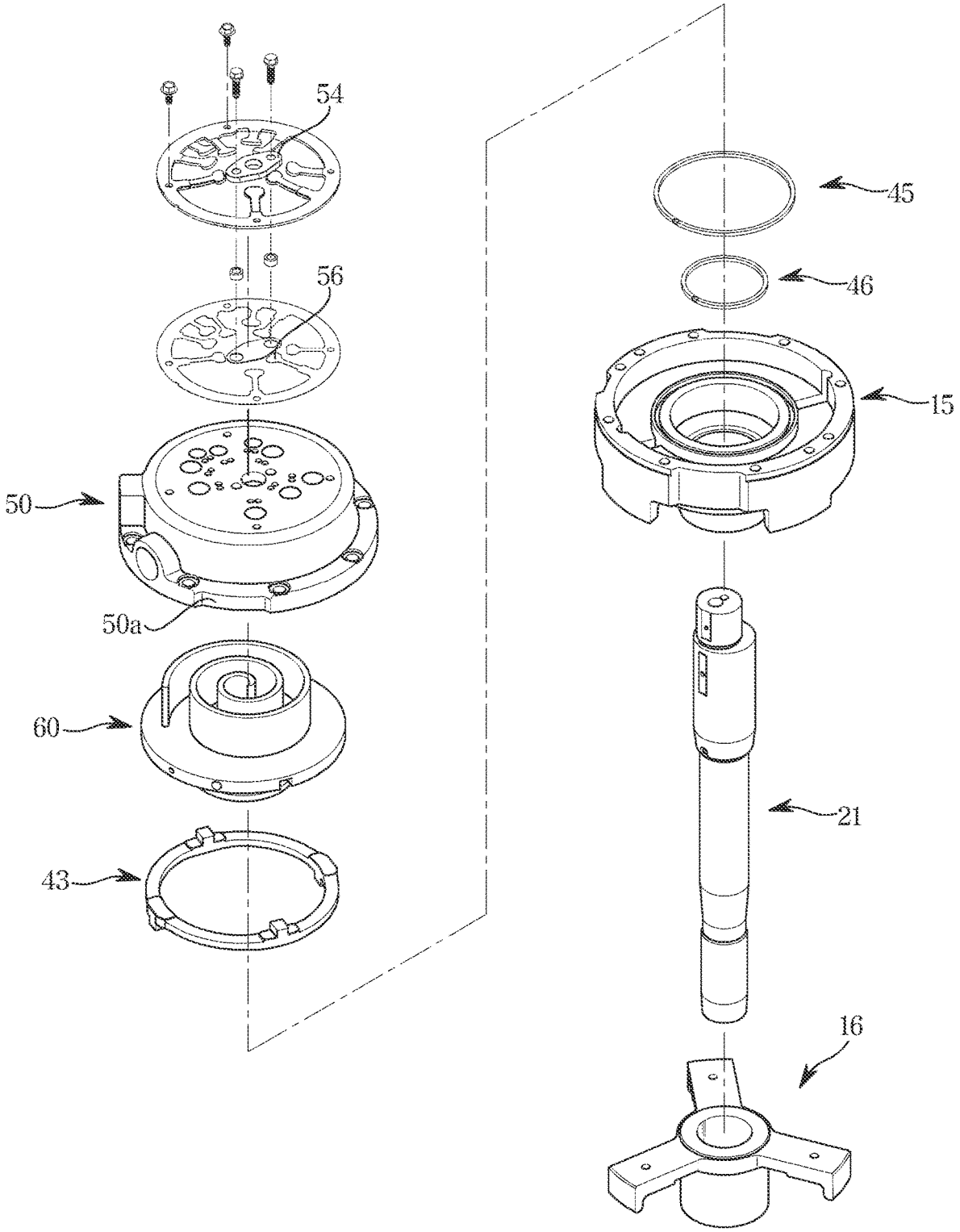
FIG. 3 is an exploded-perspective view of a main part of the scroll compressor shown in FIG. 1 according to an embodiment of the disclosure.

FIG. 3 is an exploded-perspective view of a main part of the scroll compressor shown in FIG. 1 according to an embodiment of the disclosure.

Referring to FIGS. 1 to 3, a scroll compressor 1 includes a body 10 including a sealed internal space, a compression mechanism 30 configured to compress a refrigerant, and an electric mechanism 20 configured to provide a driving force to the compression mechanism 30.

The body 10 may be formed by combining a main body 11 having a substantially cylindrical shape with an open upper end and an open lower end, an upper body 12 sealing the open upper end, and a lower body 12*a* sealing the open lower end. The body 10 may include a bottom plate 19 to be stably supported on the floor and a fixing member 18 fixing an outdoor unit sensor.

A suction pipe 13, through which the refrigerant flows, and a discharge pipe 14, through which the compressed refrigerant is discharged, may be connected to one side of the body 10. However, the arrangement of the suction pipe 13 and the discharge pipe 14 is not limited thereto.

The electric mechanism 20 may be provided at a lower portion of the body 10. The electric mechanism 20 may include an outer stator 24 and a rotor 23 rotating inside the stator 24. The electric mechanism 20 may include a rotary shaft 21 mounted on the inside of the rotor 23 and configured to rotate together with the rotor 23 so as to transmit a rotational force of the electric mechanism 20 to the compression mechanism 30.

At an upper end of the rotary shaft 21, an eccentric member 25 is formed to be biased toward one side from a rotation center of the rotary shaft 21. The eccentric member 25 may be coupled to a shaft coupler 63 of an orbiting scroll 60 to transmit a rotational force to the orbiting scroll 60. An oil supply passage 22 may be formed in the rotary shaft 21 in an axial direction of the rotary shaft 21. An oil pump (not shown) may be provided at a lower end of the oil supply passage 22.

A balance weight 17 provided to adjust a rotation unbalance during the rotation of the rotor 23 may be installed above or below the rotor 23.

The body 10 may include a main frame 15 and a sub frame 16, which are arranged in an inner upper portion and an inner lower portion of the body 10, respectively, so as to support various internal structures of the body 10. A shaft supporter 15*a* rotatably supporting the rotary shaft 21 may be formed at the center of the main frame 15.

The compression mechanism 30 may include a fixed scroll 50 fixed to the inside of the body 10 and the orbiting scroll 60 arranged below the fixed scroll 50 and configured to orbit with respect to the fixed scroll 50. The fixed scroll 50 and the orbiting scroll 60 may be provided above the main frame 15.

The fixed scroll 50 includes a fixed end plate 52 formed in a substantially flat circular shape, and a fixed wrap 51 protruding from a lower surface of the fixed end plate 52. The fixed wrap 51 may include a spiral shape. Particularly, the fixed wrap 51 may include an involute shape, an algebraic spiral shape, or a hybrid shape.

The fixed scroll 50 may be fixedly coupled to the main frame 15. The fixed scroll 50 may be screwed to the main frame 15. For this, a screw fastening hole (not shown) may be formed in the fixed scroll 50.

The orbiting scroll 60 may be coupled to the main frame 15 to orbit. The orbiting scroll 60 may include an orbiting end plate 62 formed in a substantially flat circular shape, and an orbiting wrap 61 protruding from an upper surface of the orbiting end plate 62. The shaft coupler 63 to which the rotary shaft 21 is coupled may be formed on a central lower surface of the orbiting end plate 62. The orbiting wrap 61 may include a spiral shape. The orbiting wrap 61 may include an involute shape or an algebraic spiral shape.

The fixed wrap 51 of the fixed scroll 50 and the orbiting wrap 61 of the orbiting scroll 60 are provided to be engaged with each other so as to form a compression chamber 41 compressing the refrigerant and a suction chamber 40 sucking the refrigerant.

The refrigerant on the outside of the body 10 may be sucked through the suction pipe 13 and stored in the suction chamber 40. As the orbiting scroll 60 orbits, the sucked refrigerant moves to the center of the compression chamber 41 and a volume of the compression chamber 41 is reduced to compress the refrigerant. The refrigerant compressed in the compression chamber 41 may be discharged to an upper discharge portion 42.

A discharge hole 53 discharging the refrigerant compressed in the compression chamber 41 to the upper discharge portion 42 of the main body 11 may be formed in the center of the fixed scroll 50. A discharge port opening and closing valve 54 configured to open and close the discharge hole 53 may be formed at an upper end of the fixed scroll 50.

Most of the high-pressure refrigerant discharged to the upper discharge portion 42 arranged on the outside of the fixed scroll 50 may be discharged to the outside of the body 10 through the discharge pipe 14. A portion of the high-pressure refrigerant may be moved to the lower portion of the body 10 through a first communicating portion 50*a* provided on an outer circumferential surface of the fixed scroll 50 and through a second communicating portion provided on an outer circumferential of the main frame 15.

The fixed scroll 50 may include a plurality of bypass members 56 arranged on an upper surface thereof and provided to selectively bypass the refrigerant of the compression chamber 41 into a space inside the body 10. The refrigerant of the compression chamber 41 may be bypassed from the compression chamber 41 to the space inside the body 10 through a bypass hole 55.

A first back pressure chamber 70 may be provided between the orbiting scroll 60 and the main frame 15. The first back pressure chamber 70 may be surrounded by the orbiting end plate 62 and the main frame 15. An Oldham ring 43 provided to allow the orbiting scroll 60 to orbit while preventing the orbiting scroll 60 from pivoting may be accommodated in the first back pressure chamber 70.

An oil storage space 90 may be provided at a lower portion of the body 10. A lower end of the rotary shaft 21 may extend to the oil storage space 90 to allow the oil in the oil storage space 90 to rise through the oil supply passage 22 of the rotary shaft 21.

The oil stored in the oil storage space 90 may be pumped by an oil pump (not shown) installed at the lower end of the rotary shaft 21 and rise to the upper end of the rotary shaft 21 along the oil supply passage 22 formed inside the rotary shaft 21. The oil reaching the upper end of the rotary shaft 21 may be supplied to each component according to the rotation of the orbiting scroll 60, so as to lubricate each component.

An internal pressure of the compression chamber 41 may act in a direction in which the orbiting scroll 60 moves away from the fixed scroll 50. In order to respond to the pressure, the back pressure chambers 70 and 80 transmitting the pressure to a direction in which the orbiting scroll 60 faces the fixed scroll 50 may be provided under the orbiting scroll 60.

A refrigerant having an intermediate pressure may be filled in the back pressure chambers 70 and 80 through a first flow path 71 and a second flow path 81.

The back pressure chambers 70 and 80 may include the first back pressure chamber 70 and a second back pressure chamber 80. The first back pressure chamber 70 may be formed by the main frame 15 and the orbiting scroll 60. Particularly, the first back pressure chamber 70 may be arranged on the outer circumference of the orbiting end plate 62. The first back pressure chamber 70 may be surrounded by the lower surface of the outer circumferential side of the orbiting end plate 62 and the main frame 15. On the edge of the upper surface of the main frame 15, the first back pressure chamber 70 may be provided to have a predetermined internal volume with a lower surface of the orbiting scroll 60. The first back pressure chamber 70 may include an Oldham ring.

The refrigerant of the compression chamber 41 may flow into the first back pressure chamber 70 through the first flow path 71. In the first back pressure chamber 70, the refrigerant may be discharged into the compression chamber 41 through the first flow path 71. That is, the first flow path 71 may allow the first back pressure chamber 70 and the compression chamber 41 to communicate with each other.

The first flow path 71 may be provided to pass through the orbiting scroll 60 so as to communicate with the first back pressure chamber 70 at the outer side of the upper surface of the orbiting end plate 62. The first flow path 71 is provided to include an "L" shape, but is not limited thereto. However, the first flow path 71 may be provided in various shapes as long as capable of allowing the compression chamber 41 and the first back pressure chamber 70 to communicate with each other.

The second back pressure chamber 80 may be formed by the main frame 15 and the orbiting scroll 60. Particularly, the second back pressure chamber 80 may be arranged below an inner circumference of the orbiting end plate 62. The second back pressure chamber 80 may be surrounded by the shaft coupler 63 and the main frame 15. The second back pressure chamber 80 may be arranged on an inner circumferential side than the first back pressure chamber 70.

The refrigerant of the compression chamber 41 may flow into the second back pressure chamber 80 through the second flow path 81. In the second back pressure chamber 80, the refrigerant may be discharged into the compression chamber 41 through the second flow path 81. That is, the second flow path 81 may allow the second back pressure chamber 80 and the compression chamber 41 to communicate with each other.

The second flow path 81 may be provided to pass through the orbiting scroll 60 so as to communicate with the second back pressure chamber 80 on the inner side of the upper surface of the orbiting end plate 62. The second flow path 81 is provided to include a cylindrical shape, but is not limited thereto. Therefore, the second flow path 81 may be provided in various shapes as long as capable of allowing the compression chamber 41 and the second back pressure chamber 80 to communicate with each other.

The scroll compressor 1 may include a first sealing member 45 and a second sealing member 46. The first sealing member 45 may be arranged in a first sealing member mounting groove **45*a* (refer to FIG. 6). The first sealing member mounting groove 45*a* may be formed between the orbiting end plate 62 and the main frame 15. Particularly, the first sealing member mounting groove 45*a* may be arranged between the lower surface of the orbiting end plate 62 and the main frame 15**.

The first sealing member 45 may be mounted to the first sealing member mounting groove **45*a*. The first sealing member 45 may float in the first sealing member mounting groove 45*a* in response to the driving of the scroll compressor 1. Accordingly, the first sealing member 45 may separate the first back pressure chamber 70 and the second back pressure chamber 80** from each other.

Figure 7:
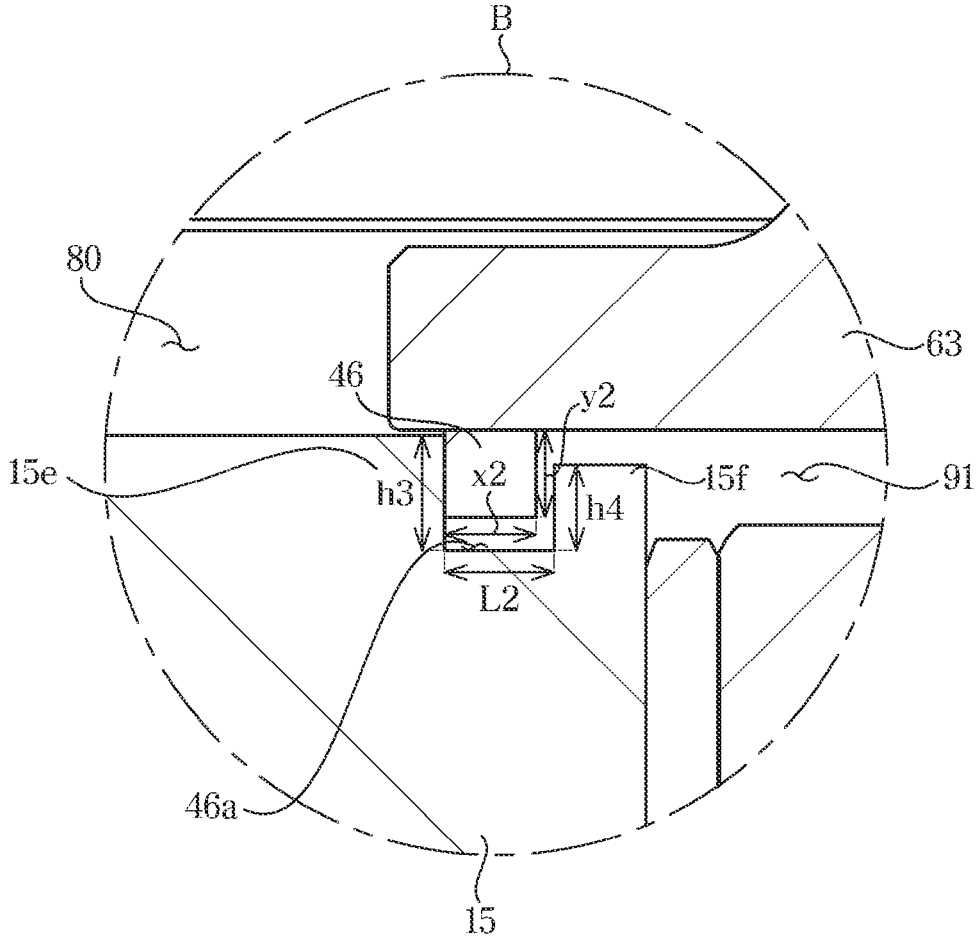
FIG. 7 is an enlarged view of part 'B' of FIG. 5 according to an embodiment of the disclosure.

The second sealing member 46 may be arranged in a second sealing member mounting groove **46*a* (refer to FIG. 7). The second sealing member mounting groove 46*a* may be formed between the shaft coupler 63 and the main frame 15. Particularly, the second sealing member mounting groove 46*a* may be arranged between the lower surface of the shaft coupler 63 and the main frame 15**.

The second sealing member 46 may be mounted to the second sealing member mounting groove **46*a*. The second sealing member 46 may float in the second sealing member mounting groove 46*a* in response to the driving of the scroll compressor 1. Accordingly, the second sealing member 46 may separate the second back pressure chamber 80 and a high-pressure region 91 (refer to FIG. 5**) inside the sealed container.

The scroll compressor 1 according to an embodiment of the disclosure will be described in detail with reference to FIGS. 4 to 7.

Figure 4:
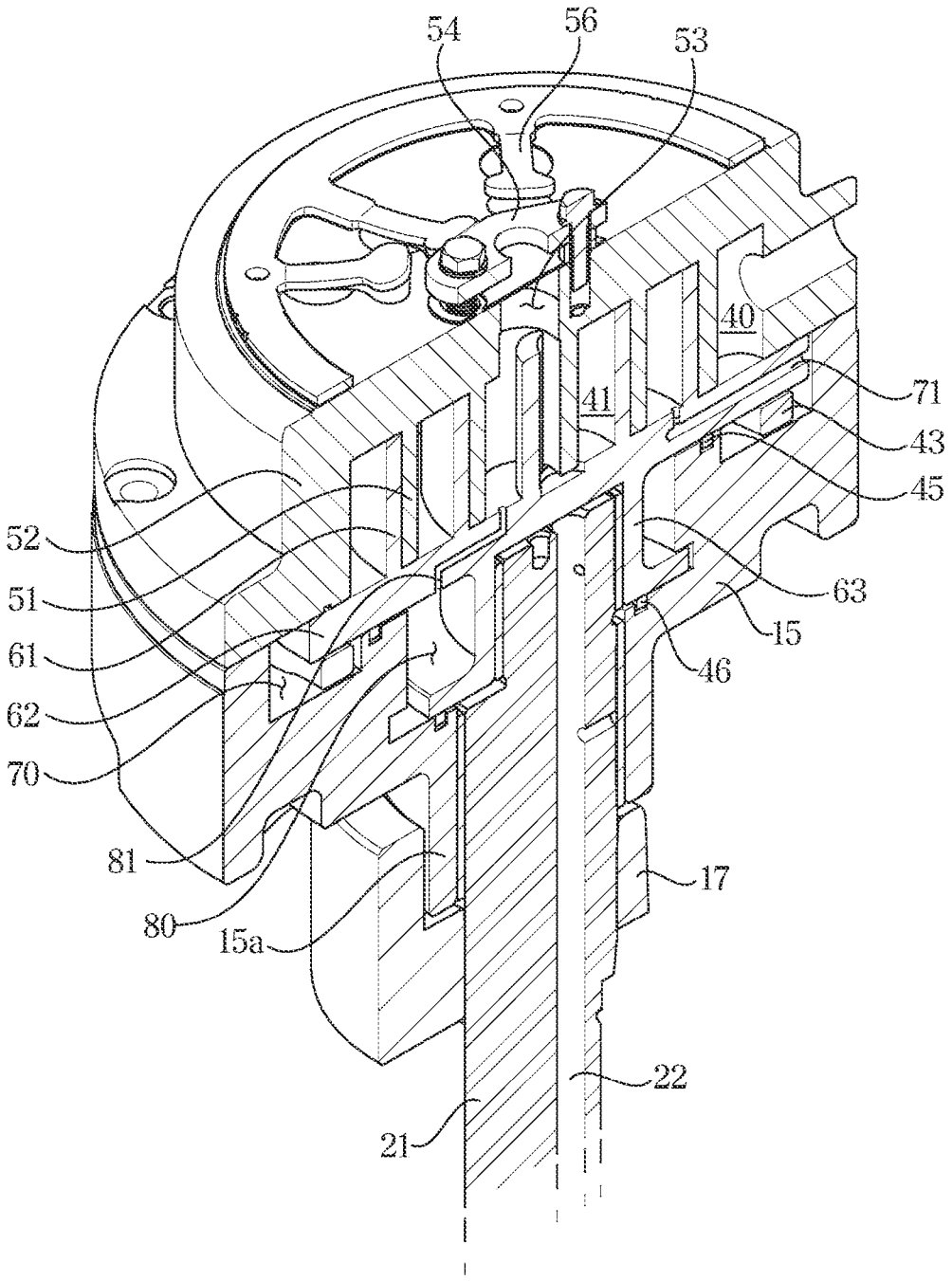
FIG. 4 is a partial-cutaway view of the orbiting scroll shown in FIG. 2 according to an embodiment of the disclosure.

FIG. 4 is a partial-cutaway view of the orbiting scroll shown in FIG. 2 according to an embodiment of the disclosure.

Figure 5:
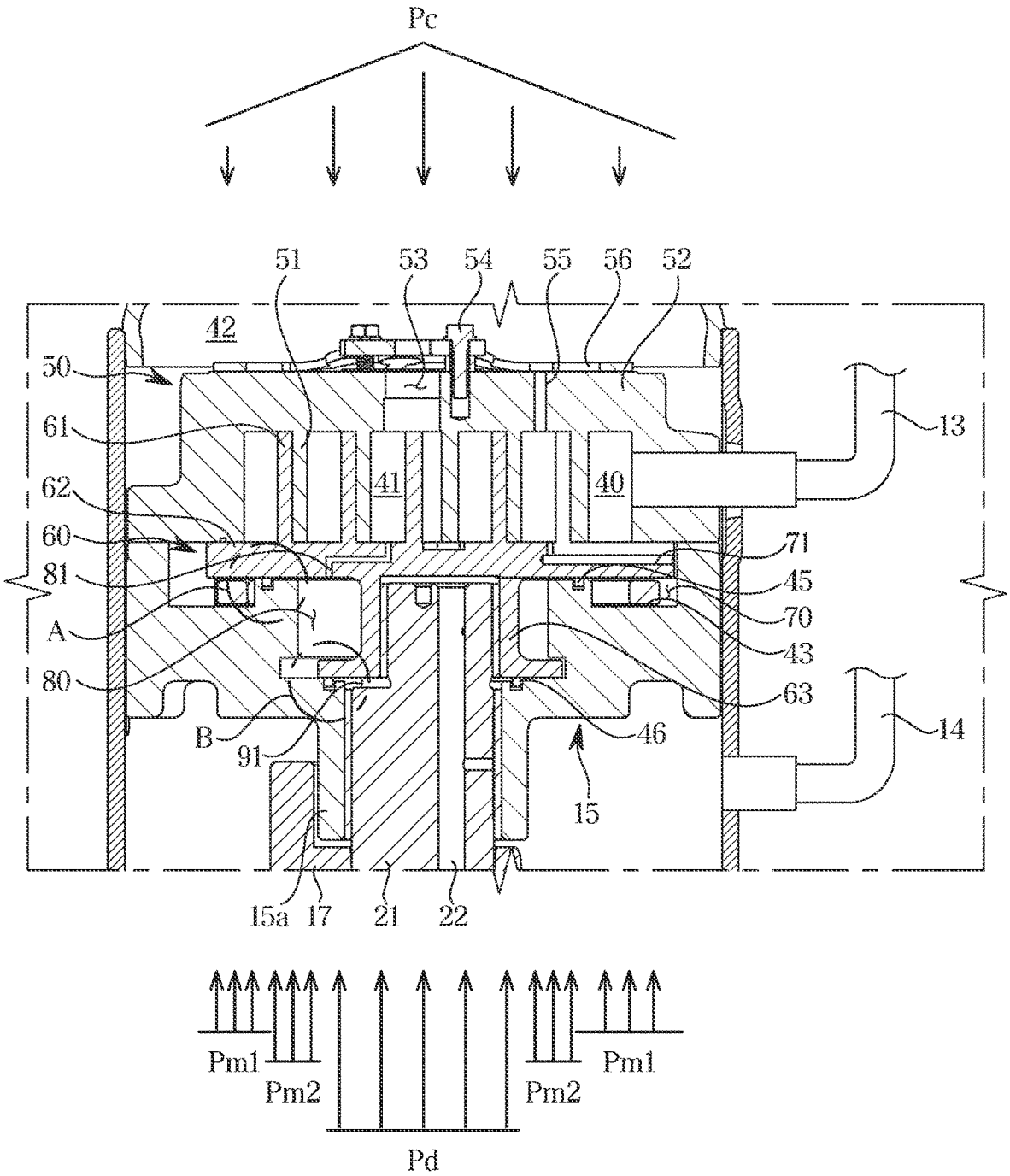
FIG. 5 is an enlarged view of the scroll compressor shown in FIG. 2 according to an embodiment of the disclosure.

FIG. 5 is an enlarged view of the scroll compressor shown in FIG. 2 according to an embodiment of the disclosure.

Figure 6:
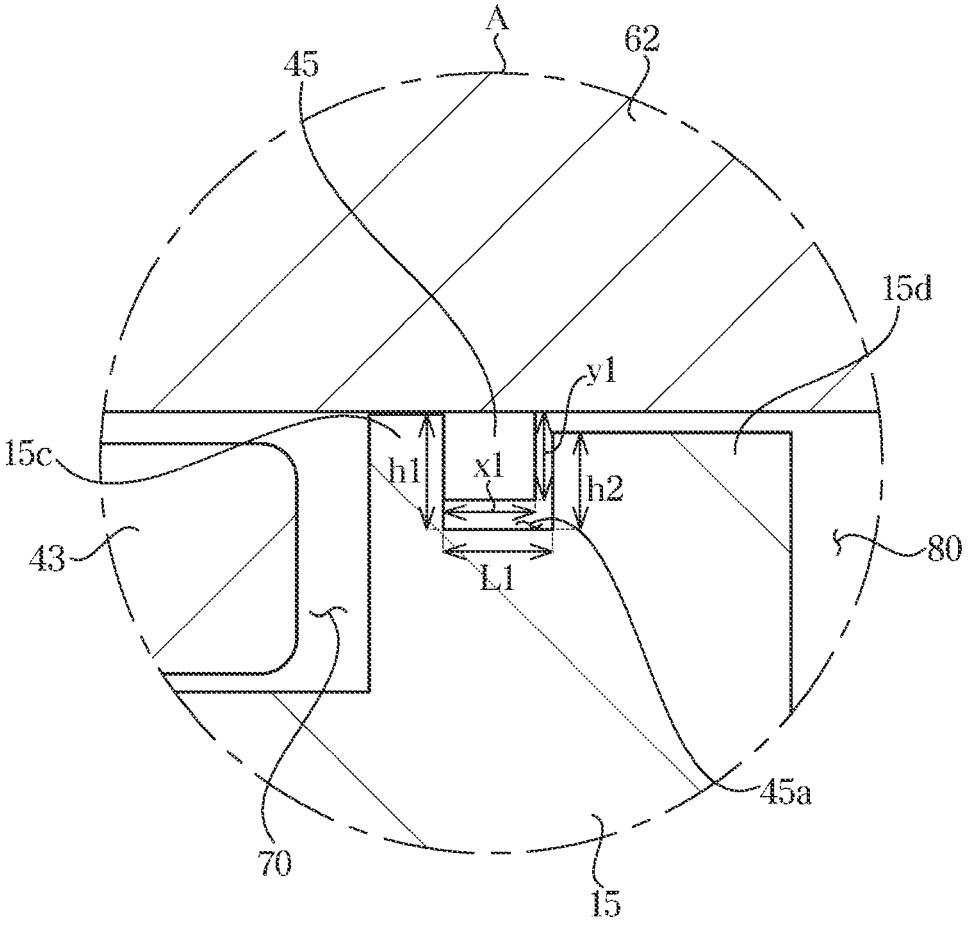
FIG. 6 is an enlarged view of part 'A' of FIG. 5 according to an embodiment of the disclosure.

FIG. 6 is an enlarged view of part 'A' of FIG. 5 according to an embodiment of the disclosure.

FIG. 7 is an enlarged view of part 'B' of FIG. 5 according to an embodiment of the disclosure.

As the scroll compressor 1 is driven, the orbiting scroll 60 may receive a force in a direction away from the fixed scroll 50. In order to correspond the force, it is required to apply a pressure to the orbiting scroll 60 in a direction from the lower side of the orbiting scroll 60 toward the fixed scroll 50.

Particularly, a pressure Pc of the compression chamber 41 may be a pressure that increases as the refrigerant, which is in the compression chamber 41 formed by the orbiting scroll 60 and the fixed scroll 50, moves to the center. The pressure Pc of the compression chamber 41 may be applied to the orbiting scroll 60 in a direction from the upper side to the lower side of the orbiting scroll 60.

On the other hand, a discharge pressure Pd, a pressure Pm1 of the first back pressure chamber 70, and a pressure Pm2 of the second back pressure chamber 80 may be formed under the orbiting scroll 60. The discharge pressure Pd may be a pressure of the high-pressure region 91 inside the sealed container. A back pressure is obtained by multiplying the discharge pressure Pd, the pressure Pm1 of the first back pressure chamber 70, the pressure Pm2 of the second back pressure chamber 80, and an area acting thereon. The back pressure may be greater than a gas force caused by the pressure Pc of the compression chamber 41.

For this, different pressures may be formed in the first back pressure chamber 70 and the second back pressure chamber 80. The pressure Pm1 of the first back pressure chamber 70 may be less than the pressure Pm2 of the second back pressure chamber 80.

The main frame 15 may include a first outer wall 15*c* and a first inner wall 15*d*. The first outer wall 15*c* may support the orbiting scroll 60. The first inner wall 15*d* may be inwardly spaced apart from the first outer wall 15*c*, so as to form the first sealing member mounting groove 45*a*. The first outer wall 15*c* and the first inner wall 15*d* may form a step difference.

The first sealing member mounting groove 45*a* may be provided to have a predetermined volume by the lower surface of the orbiting end plate 62 and the upper surface of the main frame 15. The first outer wall 15*c* may be arranged on the outer circumference of the first sealing member mounting groove 45*a*. The first inner wall 15*d* may be arranged on the inner circumferential side of the first sealing member mounting groove 45*a*. A height h1 of the first outer wall 15*c* may be greater than a height h2 of the first inner wall 15*d*.

A first direction length x1 of the first sealing member 45 may be less than a first direction length L1 of the first sealing member mounting groove 45*a*. A second direction length y1 of the first sealing member 45 may be less than the height h1 of the first outer wall 15*c*.

The first sealing member 45 may move in an outward direction because the pressure Pm2 of the second back pressure chamber 80, which is a pressure in a direction from an inner side to an outer side, is greater than the pressure Pm1 of the first back pressure chamber 70 which is a pressure in a direction from the outer side to the inner side. The first sealing member 45 may float upward while being inscribed with the first outer wall 15*c*.

In response to the driving of the scroll compressor 1, the first sealing member 45 may separate the first back pressure chamber 70 and the second back pressure chamber 80 from each other while floating in the first sealing member mounting groove 45*a*, due to the above-mentioned structure.

Accordingly, the pressure Pm1 of the first back pressure chamber 70 and the pressure Pm2 of the second back pressure chamber 80 may be maintained. The pressure Pm1 of the first back pressure chamber 70 and the pressure Pm2 of the second back pressure chamber 80 may be formed to correspond to the pressure Pc of the compression chamber 41 that increases toward the center of the scroll compressor 1. The pressure Pm2 of the second back pressure chamber 80 may be greater than the pressure Pm1 of the first back pressure chamber 70.

A uniform intermediate back pressure according to a conventional manner may cause friction loss of a component of a scroll compressor and axial leakage under a condition being greater or less than a reference cooling load. In comparison with the uniform intermediate back pressure corresponding to the pressure Pc of the compression chamber 41, the pressure Pm1 of the first back pressure chamber 70 and the pressure Pm2 of the second back pressure chamber 80 may relatively more correspond to the pressure Pc of the compression chamber 41. That is, under a condition being less than the reference cooling load, a difference between the pressure Pc of the compression chamber 41 and the pressure Pm1 of the first back pressure chamber 70 or a difference between the pressure Pc of the compression chamber 41 and the pressure Pm2 of the second back pressure chamber 80 may not be less than that of the conventional manner, by adding one more back pressure chamber. Accordingly, it is possible to reduce leakage in the axial direction that may occur while the orbiting scroll 60 tilts.

In addition, under a condition being greater than the reference cooling load, a difference between the pressure Pc of the compression chamber 41 and the pressure Pm1 of the first back pressure chamber 70 or a difference between the pressure Pc of the compression chamber 41 and the pressure Pm2 of the second back pressure chamber 80 may not be greater than that of the conventional manner, by adding one more back pressure chamber. Accordingly, it is possible to prevent friction loss of the component of the scroll compressor that may occur when the fixed scroll 50 and the orbiting scroll 60 come into contact with each other. At the same time, because the orbiting scroll 60 moves downward faster when the liquid is introduced, it is possible to prevent damage to the fixed wrap 51 and the orbiting wrap 61 in the compression chamber 41.

The main frame 15 may include a second outer wall 15*e* and a second inner wall 15*f*. The second inner wall 15*f* may be inwardly spaced apart from the second outer wall 15*e* to form the second sealing member mounting groove 46*a*. The second outer wall 15*e* and the second inner wall 15*f* may form a step difference.

The second sealing member mounting groove 46*a* may be provided to have a predetermined volume by the lower surface of the shaft coupler 63 and the upper surface of the main frame 15. The second outer wall 15*e* may be arranged on the outer circumference of the second sealing member mounting groove 46*a*. The second inner wall 15*f* may be arranged on the inner circumferential side of the second sealing member mounting groove 46*a*. A height h3 of the second outer wall 15*e* may be greater than a height h4 of the second inner wall 15*f*.

A first direction length x2 of the second sealing member 46 may be less than a first direction length L2 of the second sealing member mounting groove 46*a*. A second direction length y2 of the second sealing member 46 may be less than the height h3 of the second outer wall 15*e*.

The second sealing member 46 may move in an outward direction because the discharge pressure Pd, which is a pressure in a direction from an inner side to an outer side, is greater than the pressure Pm2 of the second back pressure chamber 80 which is a pressure in a direction from the outer side to the inner side. The second sealing member 46 may float upward while being inscribed with the second outer wall 15*e*.

In response to the driving of the scroll compressor 1, the second sealing member 46 may separate the second back pressure chamber 80 and the high-pressure region 91 inside the sealed container, from each other, while floating in the second sealing member mounting groove 46*a*, due to the above-mentioned structure.

Accordingly, the discharge pressure Pd and the pressure Pm2 of the second back pressure chamber 80 may be maintained. The discharge pressure Pd and the pressure Pm2 of the second back pressure chamber may be formed to correspond to the pressure Pc of the compression chamber 41 that increases toward the center of the scroll compressor. The discharge pressure Pd may be greater than the pressure Pm2 of the second back pressure chamber.

In the driving of the orbiting scroll 60, the pressure Pm1 of the first back pressure chamber 70, the pressure Pm2 of the second back pressure chamber 80, and the discharge pressure Pd may move the orbiting scroll 60 toward the direction of the fixed scroll 50. The pressure Pm2 of the second back pressure chamber 80 may be greater than the pressure Pm1 of the first back pressure chamber 70, and the discharge pressure Pd may be greater than the pressure Pm2 of the second back pressure chamber 80.

Due to the subdivision of the pressure Pm1 of the first back pressure chamber 70 and the pressure Pm2 of the second back pressure chamber 80, it is possible to reduce the friction loss of the component of the scroll compressor and leakage in the axial direction. At the same time, because the orbiting scroll 60 moves downward faster when the liquid is introduced, it is possible to prevent damage to the fixed wrap 51 and the orbiting wrap 61 in the compression chamber 41.

According to an embodiment of the disclosure, the scroll compressor 1 is illustrated as including two back pressure chambers and two flow paths for the communication between the back pressure chamber and the compression chamber, but is not limited thereto.

The structure of the scroll compressor 1 according to an embodiment of the disclosure will be described in detail with reference to FIGS. 8 and 9. A description of the same configuration as in the above-mentioned embodiment may be omitted.

Figure 8:
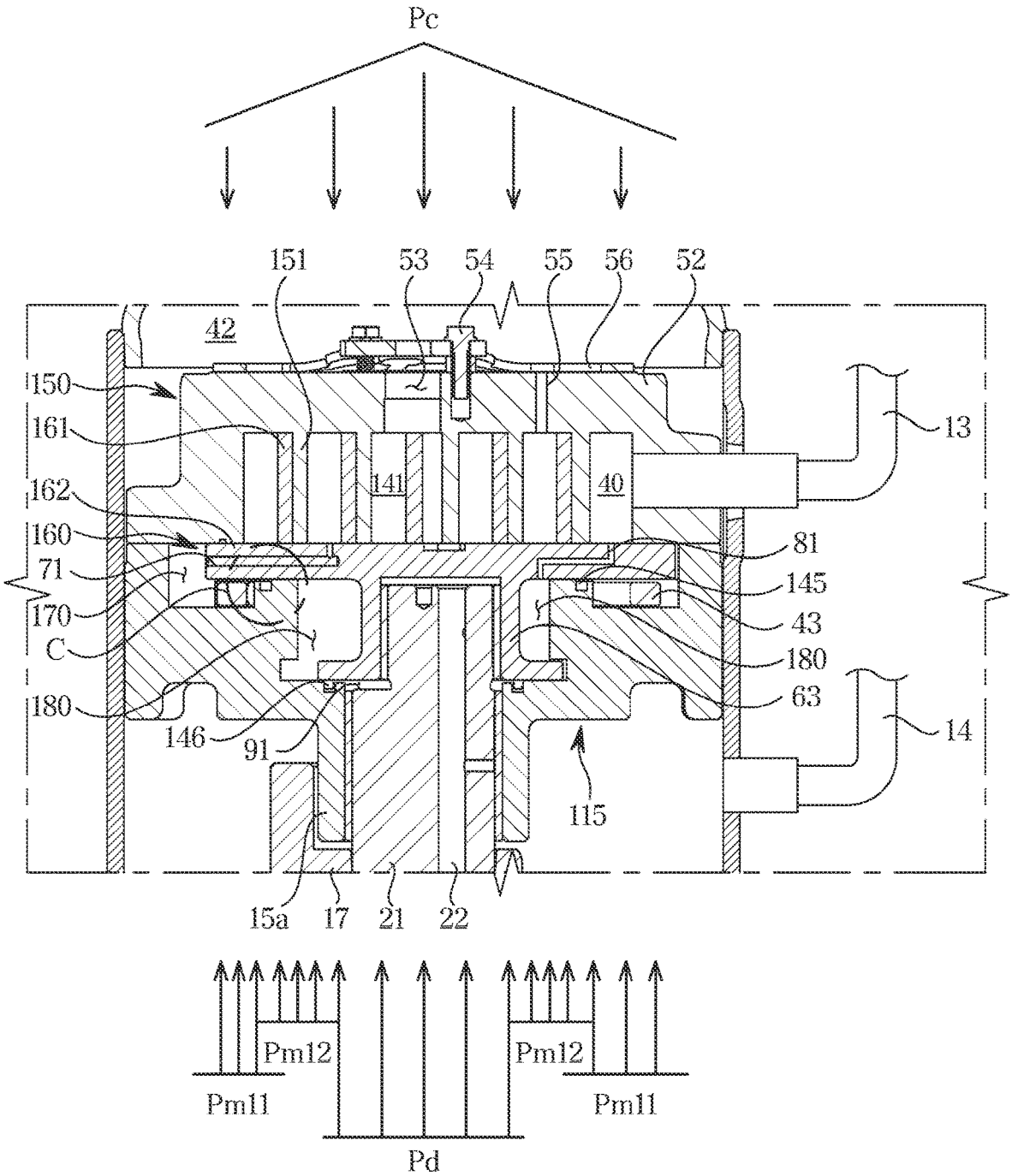
FIG. 8 is an enlarged view of a scroll compressor according to an embodiment of the disclosure.

FIG. 8 is an enlarged view of a scroll compressor according to an embodiment of the disclosure.

Figure 9:
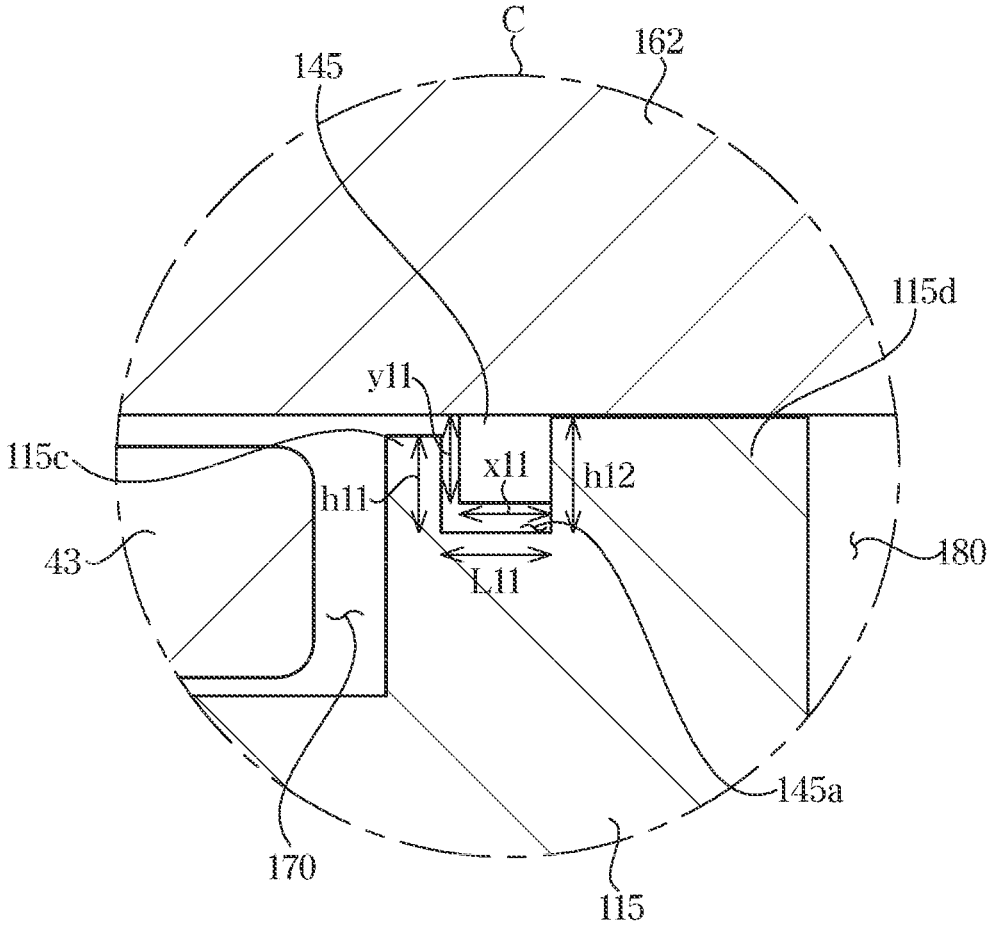
FIG. 9 is an enlarged view of part 'C' of FIG. 8 according to an embodiment of the disclosure.

FIG. 9 is an enlarged view of part 'C' of FIG. 8 according to an embodiment of the disclosure.

A pressure Pc of a compression chamber 141 may be a pressure that increases as a refrigerant in the compression chamber 141 formed by an orbiting scroll 160 and a fixed scroll 150 moves to the center. The pressure Pc of the compression chamber 141 may be applied to the orbiting scroll 160 in a direction from the upper side to the lower side of the orbiting scroll 160.

On the other hand, a discharge pressure Pd, a pressure Pm11 of a first back pressure chamber 170, and a pressure Pm12 of a second back pressure chamber 180 may be formed under the orbiting scroll 160. The discharge pressure Pd, the pressure Pm11 of the first back pressure chamber 170, and the pressure Pm12 of the second back pressure chamber 180 may be greater than the pressure Pc of the compression chamber.

For this, different pressures may be formed in the first back pressure chamber 170 and the second back pressure chamber 180. The pressure Pm11 of the first back pressure chamber 170 may be greater than the pressure Pm12 of the second back pressure chamber 180.

A main frame 115 may include a first outer wall 115*c* and a first inner wall 115*d*. The first inner wall 115*d* may support the orbiting scroll 160. The first inner wall 115*d* may be inwardly spaced apart from the first outer wall 115*c*, so as to form a first sealing member mounting groove 145*a*. The first outer wall 115*c* and the first inner wall 115*d* may form a step difference. A height of the first outer wall 115*c* may be different from a height of the first inner wall 115*d*.

The first sealing member mounting groove 145*a* may be provided to have a predetermined volume by a lower surface of an orbiting end plate 162 and an upper surface of the main frame 115. The first outer wall 115*c* may be arranged on an outer circumferential side of the first sealing member mounting groove 145*a*. The first inner wall 115*d* may be arranged on an inner circumferential side of the first sealing member mounting groove 145*a*. A height h12 of the first inner wall 115*d* may be greater than a height h11 of the first outer wall 115*c*. The height h11 of the first outer wall 115*c* may be less than the height h12 of the first inner wall 115*d*.

A first direction length x11 of a first sealing member 145 may be less than a first direction length L11 of the first sealing member mounting groove 145*a*. A second direction length y11 of the first sealing member 145 may be less than the height h12 of the first inner wall 115*d*.

The first sealing member 145 may move in an inward direction because the pressure Pm11 of the first back pressure chamber 170 which is a pressure in a direction from an outer side to an inner side is greater than the pressure Pm12 of the second back pressure chamber 180, which is a pressure in a direction from the inner side to the outer side. The first sealing member 145 may float upward while being inscribed with the first inner wall 115*d*.

In response to the driving of the scroll compressor 1, the first sealing member 145 may separate the first back pressure chamber 170 and the second back pressure chamber 180 from each other while floating in the first sealing member mounting groove 145*a*, due to the above-mentioned structure.

Accordingly, the pressure Pm11 of the first back pressure chamber 170 and the pressure Pm12 of the second back pressure chamber 180 may be maintained. In comparison with a uniform intermediate back pressure in the conventional manner, corresponding to the pressure Pc of the compression chamber 141, it is possible to relatively more correspond to the pressure Pc of the compression chamber 141 due to the above-mentioned structure. That is, under a condition being less than the reference cooling load, a difference between the pressure Pc of the compression chamber 141 and the pressure Pm11 of the first back pressure chamber 170 or a difference between the pressure Pc of the compression chamber 141 and the pressure Pm12 of the second back pressure chamber 180 may not be less than that of the conventional manner, by adding one more back pressure chamber. In addition, under a condition being greater than the reference cooling load, a difference between the pressure Pc of the compression chamber 141 and the pressure Pm11 of the first back pressure chamber 170 or a difference between the pressure Pc of the compression chamber 141 and the pressure Pm12 of the second back pressure chamber 180 may not be greater than that of the conventional manner, by adding one more back pressure chamber.

Accordingly, it is possible to reduce leakage in the axial direction that may occur while the orbiting scroll 160 tilts or it is possible to prevent friction loss of the component of the scroll compressor that may occur when the fixed scroll 150 and the orbiting scroll 160 come into contact with each other. At the same time, it is possible to prevent damage to a fixed wrap 151 and an orbiting wrap 161 in the compression chamber 141 that may occur when the liquid is introduced.

In addition, because the pressure Pm12 of the second back pressure chamber 180 is set to be greater than the pressure Pm11 of the first back pressure chamber 170, it is possible to prevent that the orbiting scroll 160 is deformed upward as being toward the center.

Other structure such as the second sealing member 146, the second sealing member mounting groove 146*a*, and the second outer wall and the second inner wall may be the same as that of the above-mentioned embodiment.

As is apparent from the above description, a scroll compressor may reduce friction loss and axial leakage of components that may occur under a load different from a reference cooling load.

By retracting an orbiting scroll more quickly when liquid is introduced, a scroll compressor may prevent wrap breakage caused by liquid compression.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A scroll compressor comprising:

a fixed scroll;

an orbiting scroll configured to orbit with respect to the fixed scroll and including an orbiting end plate;

a main frame to which the orbiting scroll is coupled to orbit;

a compression chamber formed between the fixed scroll and the orbiting scroll;

a first back pressure chamber formed by the main frame and the orbiting scroll;

a first flow path provided to allow the first back pressure chamber and the compression chamber to communicate with each other;

a second back pressure chamber formed by the main frame and the orbiting scroll and provided to be separated from the first back pressure chamber in response to an orbital motion of the orbiting scroll;

a second flow path provided to allow the second back pressure chamber and the compression chamber to communicate with each other; and a first sealing member mounting groove formed between the orbiting end plate and the main frame, wherein the main frame comprises a first outer wall, and a first inner wall inwardly spaced apart from the first outer wall so as to form the first sealing member mounting groove, and wherein a height of the first outer wall is greater than a height of the first inner wall.

2. The scroll compressor of claim 1, wherein a pressure of the first back pressure chamber is different from a pressure of the second back pressure chamber.

3. The scroll compressor of claim 2, wherein the pressure of the first back pressure chamber is less than the pressure of the second back pressure chamber.

4. The scroll compressor of claim 1, further comprising:

a first sealing member arranged in the first sealing member mounting groove.

5. The scroll compressor of claim 4, wherein the first sealing member floats in the first sealing member mounting groove in response to driving of the scroll compressor, and wherein the first sealing member separates the first back pressure chamber from the second back pressure chamber.

6. The scroll compressor of claim 4, wherein the orbiting scroll further comprises a shaft coupler extending downwardly from the orbiting end plate, and wherein the second back pressure chamber is formed by the shaft coupler and the main frame.

7. The scroll compressor of claim 6, further comprising:

a second sealing member mounting groove formed by a rear surface of the shaft coupler and the main frame; and a second sealing member arranged in the second sealing member mounting groove.

8. The scroll compressor of claim 7, wherein the main frame further comprises;

a second outer wall provided to support a bottom of the shaft coupler; and a second inner wall inwardly spaced apart from the second outer wall so as to form the second sealing member mounting groove.

9. The scroll compressor of claim 8, wherein a height of the second outer wall is greater than a height of the second inner wall.

10. The scroll compressor of claim 7, wherein the second sealing member floats in the second sealing member mounting groove in response to driving of the scroll compressor, and wherein the second sealing member separates the second back pressure chamber from a high pressure region inside a body of the scroll compressor.

11. The scroll compressor of claim 1, further comprising:

an Oldham ring provided to allow the orbiting scroll to orbit while preventing the orbiting scroll from pivoting.

12. The scroll compressor of claim 11, wherein the Oldham ring is accommodated in the first back pressure chamber.

13. The scroll compressor of claim 1, wherein the scroll compressor is configured to prevent wrap breakage caused by liquid compression by retracting the orbiting scroll when liquid is introduced into the orbiting scroll.

14. The scroll compressor of claim 1, further comprising:

an electric mechanism configured to provide a driving force to the orbiting scroll, the electric mechanism comprising:

a stator, a rotor rotating inside the stator, and a rotary shaft mounted inside of the rotor and configured to rotate with the rotor to transmit a rotational force to the orbiting scroll.

15. The scroll compressor of claim 1, wherein an internal pressure of the compression chamber acts in a direction in which the orbiting scroll moves away from the fixed scroll.

16. A scroll compressor comprising:

a fixed scroll;

an orbiting scroll configured to orbit with respect to the fixed scroll and including an orbiting end plate;

a main frame to which the orbiting scroll is coupled to orbit;

a compression chamber formed between the fixed scroll and the orbiting scroll;

a first back pressure chamber formed by the main frame and the orbiting scroll;

a first flow path provided to allow the first back pressure chamber and the compression chamber to communicate with each other;

a second back pressure chamber formed by the main frame and the orbiting scroll and provided to be separated from the first back pressure chamber in response to an orbital motion of the orbiting scroll; and a second flow path provided to allow the second back pressure chamber and the compression chamber to communicate with each other, wherein the main frame comprises a first outer wall and a first inner wall having different heights, and wherein a height of the first outer wall is greater than a height of the first inner wall.

* * * * *